US006259213B1

(12) United States Patent
Rudolph

(10) Patent No.: US 6,259,213 B1
(45) Date of Patent: Jul. 10, 2001

(54) CIRCUIT ARRANGEMENT FOR OPERATING AT LEAST ONE LOW-PRESSURE DISCHARGE LAMP

(75) Inventor: Bernd Rudolph, München (DE)

(73) Assignee: Ratent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/494,561

(22) Filed: Jan. 31, 2000

(30) Foreign Application Priority Data

Feb. 11, 1999 (DE) ..... 199 05 487

(51) Int. Cl.[7] ..... H05B 37/02

(52) U.S. Cl. ..... 315/209 R; 315/291; 315/247; 315/244; 315/DIG. 7

(58) Field of Search ..... 315/209 R, 205, 315/247, 225, 226, 291, 106, DIG. 2, DIG. 7, 244

(56) References Cited

U.S. PATENT DOCUMENTS

| | | | | |
|---|---|---|---|---|
| 4,808,887 | * | 2/1989 | Fahnrich et al. | 315/247 |
| 4,959,591 | * | 9/1990 | Hirschmann | 315/209 R |
| 5,521,467 | * | 5/1996 | Statnic et al. | 315/247 |
| 5,583,399 | * | 12/1996 | Rudolph | 315/291 |

* cited by examiner

*Primary Examiner*—Haissa Philogene
(74) *Attorney, Agent, or Firm*—Carlo S. Bessone

(57) ABSTRACT

The invention relates to a circuit arrangement for operating at least one low-pressure discharge lamp (LP1, LP2) on an inverter (Q1, Q2). The circuit arrangement has a simplified harmonic filter for limiting the harmonic content of the mains current. In the preferred exemplary embodiment, the harmonic filter is formed by the back-up capacitor (C2), the diode (D1), the trapezoidal capacitor (C7) and the resonance capacitor (C6).

5 Claims, 1 Drawing Sheet

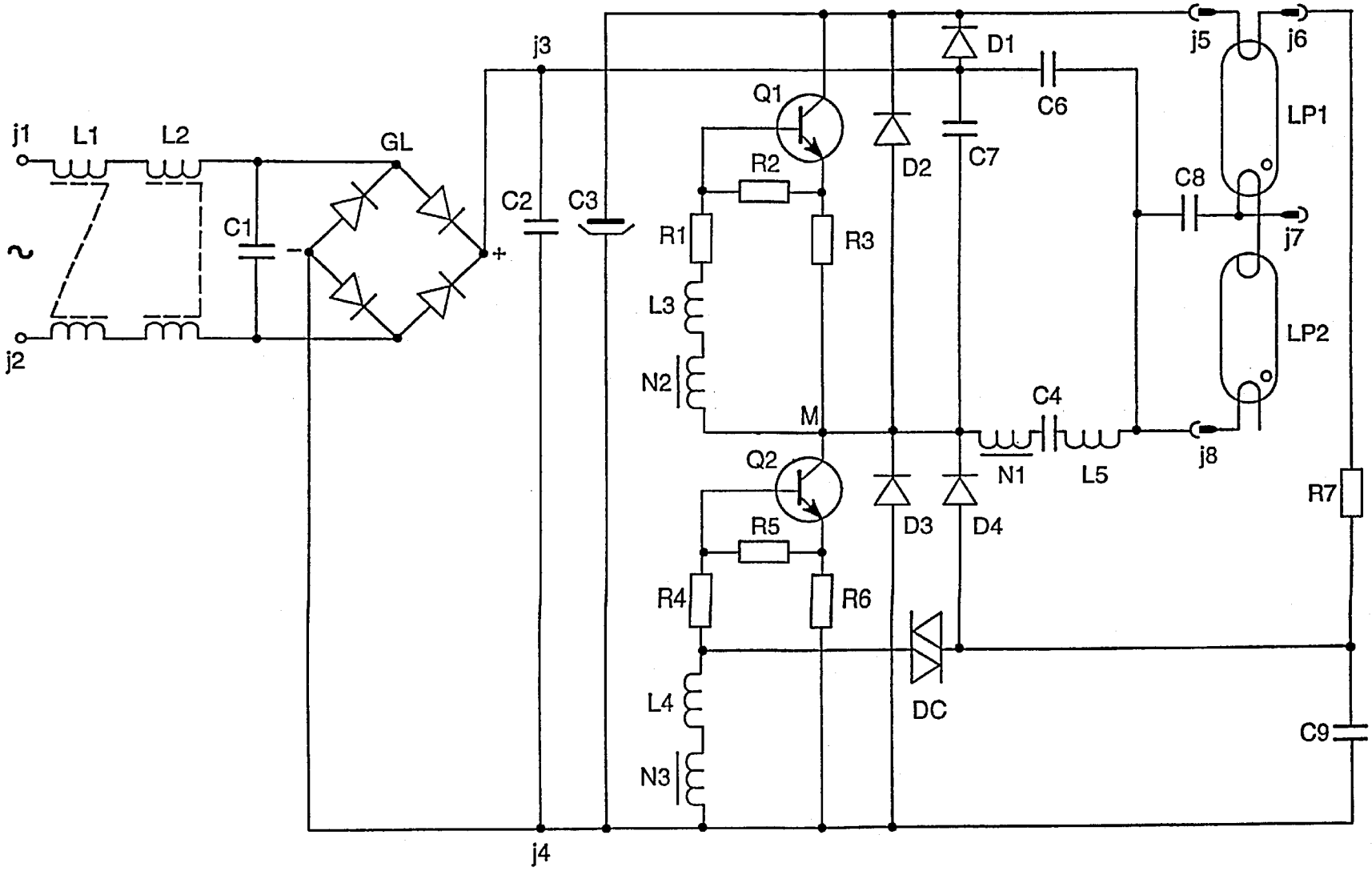
j1
j2
L1
L2
C1
GL
+
-
C2
C3
j3
j4
Q1
Q2
R1
R2
R3
R4
R5
R6
L3
L4
N2
N3
M
D1
D2
D3
D4
C6
C7
C4
N1
L5
C8
j5
j6
j7
j8
LP1
LP2
DC
R7
C9

CIRCUIT ARRANGEMENT FOR OPERATING AT LEAST ONE LOW-PRESSURE DISCHARGE LAMP

BACKGROUND OF THE INVENTION

The invention relates to a circuit arrangement for operating at least one low-pressure discharge lamp.

PRIOR ART

A circuit arrangement of this type is disclosed for example in the European Patent Specification EP 0 253 224 B1. This patent specification describes a circuit arrangement for the high-frequency operation of low-pressure discharge lamps. The circuit arrangement has a mains voltage rectifier, an inverter, a load circuit designed as a series resonant circuit, and a harmonic filter which is provided for the purpose of reducing the mains current harmonic content. The harmonic filter has a series circuit of two diodes which are connected in the forward direction to the mains voltage rectifier, a capacitor which connects the centre tap between the diodes to the voltage output of the inverter, and a further capacitor which connects the centre tap between the diodes to a tap in the series resonant circuit. In addition, the harmonic filter has two further diodes, which are connected in parallel with the two diodes of the harmonic filter and whose centre tap is connected to the voltage output of the inverter.

The European Patent Application EP 0 679 046 A1 describes a circuit arrangement for operating low-pressure discharge lamps with comparatively high running voltages. This circuit arrangement has a high-frequency rectifier bridge which interrupts the charging of the smoothing capacitor, which feeds the inverter, with the switching rhythm of the inverter and as a result, in cooperation with a storage inductor connected upstream of the high-frequency rectifier bridge and with a capacitor arranged at the output of the mains voltage rectifier, in interaction with a back-up capacitor and a negative-feedback capacitor, permits virtually sinusoidal mains current drawing with a mains power factor of >0.98.

SUMMARY OF THE INVENTION

The object of the invention is to provide a circuit arrangement for operating at least one low-pressure discharge lamp which has a simplified harmonic filter with a smaller number of electrical components.

This object is achieved according to the invention by means of the characterizing features of Patent Claim 1. Particularly advantageous embodiments of the invention are described in the subclaims.

The circuit arrangement according to the invention has a mains voltage rectifier, a capacitor connected in parallel with the DC voltage output of the mains voltage rectifier, an inverter with a load circuit connected downstream and designed as a series resonant circuit, a smoothing capacitor connected in parallel with the DC voltage input of the inverter, a harmonic filter having at least one diode and one capacitor. According to the invention, a first terminal of the at least one capacitor of the harmonic filter is connected to the resonance capacitor of the series resonant circuit, to a first electrode of the at least one diode of the harmonic filter and to the DC voltage output of the mains voltage rectifier. In addition, the second terminal of the at least one capacitor of the harmonic filter is connected to the voltage output of the inverter and the second electrode of the at least one diode of the harmonic filter is connected to the smoothing capacitor.

In this way, a circuit arrangement is provided which has a harmonic filter which is simplified and more cost-effective compared with the prior art and comprises a reduced number of electrical components. The capacitor connected in parallel with the DC voltage output of the mains voltage rectifier is advantageously dimensioned in such a way that its capacitance is at least 0.33 times the capacitance of the resonance capacitor. This advantageous dimensioning of the capacitances of the abovementioned capacitors means that even in the event that the voltage drop across the at least one low-pressure discharge lamp exceeds the voltage drop across the smoothing capacitor, virtually sinusoidal mains current drawing and a correspondingly low harmonic content are still ensured. In order to avoid undesirably high charging currents for the capacitors and thus a high loading on the electrical components, the capacitance of the capacitor connected in parallel with the DC voltage output of the mains voltage rectifier is advantageously at most as large as the capacitance of the resonance capacitor.

BRIEF DESCRIPTION OF THE DRAWINGS

The sole FIGURE is a schematic illustration of the circuit arrangement according to the invention.

DESCRIPTION OF THE PREFERRED EXEMPLARY EMBODIMENT

The invention is explained in more detail below using the preferred exemplary embodiment. The figure shows a schematic illustration of the circuit arrangement according to the invention in accordance with a preferred exemplary embodiment of the invention. This circuit arrangement has a mains voltage input j1, j2 and a filter circuit which is connected to the mains voltage input j1, j2 and comprises a current-compensated filter inductor L1, a non-current-compensated filter inductor L2 and a capacitor C1, and also a mains voltage rectifier GL connected downstream of the filter circuit. A back-up capacitor C2 is connected in parallel with the DC voltage output of the mains voltage rectifier GL, at the junction points j3, j4. The anode of a diode D1 is connected to the positive output of the mains voltage rectifier GL via the junction point j3. The cathode of the diode D1 is connected to the positive terminal of a smoothing capacitor C3. The negative terminal of the smoothing capacitor C3 is connected via the junction point j4 to the negative output of the mains voltage rectifier GL. The smoothing capacitor C3 serves as a DC voltage source for a free-running half-bridge inverter formed by two transistors Q1, Q2, its driving apparatus N1, N2, N3, L3, L4, R1, R2, R4, R5 and the emitter resistors R3, R6 and also by two freewheeling diodes D2, D3 respectively connected in parallel with the collector-emitter path of one of the transistors Q1 and Q2, respectively. The DC voltage input of the half-bridge inverter Q1, Q2 which is formed by the collector terminal of the transistor Q1 and the emitter terminal of the transistor Q2 or the emitter resistor R5, is arranged in parallel with the smoothing capacitor C3. A load circuit designed as a series resonant circuit is connected to the voltage output, that is to say to the centre tap M, of the half-bridge inverter Q1, Q2. The load circuit has the primary winding N1 of the toroidal-core transformer belonging to the driving apparatus, a coupling capacitor C4, a lamp inductor L5 and a resonance capacitor C6, which are all connected in series. The centre tap M of the half-bridge inverter Q1, Q2 is connected via the primary winding N1, the coupling capacitor C4, the lamp inductor L5 and the resonance capacitor C6 to the anode of the diode D1 and to the junction point j3. The circuit arrangement furthermore has a trapezoidal capacitor C7, whose first terminal is connected to the anode of the diode D1 and to the junction point j3 and whose second terminal is connected to the centre tap M of the half-bridge inverter Q1, Q2. In addition, the circuit arrangement has a starting apparatus comprising a diac DC, a starting capacitor C9, a resistor R7 and a diode D4, and terminals j5, j6, j7, j8 for two series-connected low-pressure discharge lamps LP1, LP2 and an auxiliary ignition capacitor C8. The auxiliary ignition capacitor C8 is arranged in parallel with the second low-pressure discharge lamp LP2. A first terminal of the auxiliary ignition capacitor C8 is connected via a node in the load circuit to the resonance capacitor C6 and to the lamp inductor L5. The second terminal of the auxiliary ignition capacitor C8 is connected to the second electrode of the first low-pressure discharge lamp LP1 and to the first electrode of the second low-pressure discharge lamp LP2. The first electrode of the first low-pressure discharge lamp LP1 is connected via the terminal j5 to the cathode of the diode D1, to the collector of the transistor Q1 and to the positive terminal of the smoothing capacitor C3 and via the terminal j6, the resistor R7 the starting capacitor C9 to the terminal j4 and also to the negative terminal of the smoothing capacitor C3. The second electrode of the second low-pressure discharge lamp LP2 is connected via the terminal j8 to the lamp inductor L5, to the resonance capacitor C6 and to the auxiliary ignition capacitor C8.

The starting apparatus serves for initiating oscillation of the half-bridge inverter Q1, Q2. After the operating unit has been switched on, the diac DC generates trigger pulses for the base of the transistor Q2. For this purpose, one terminal of the diac DC is connected to a tap arranged between the resistor R7 and the starting capacitor C9, while the other terminal of the diac DC is connected to the base of the transistor Q2 via the base series resistor R4. In addition, the abovementioned tap arranged between the starting capacitor C9, the resistor R7 and the diac DC is connected via a forward-bias diode D4 to the centre tap M of the half-bridge inverter Q1, Q2.

The inverter is designed as a free-running half-bridge inverter with two bipolar transistors Q1, Q2. The inverter is essentially driven by means of the toroidal-core transformer N1, N2, N3, whose primary winding N1 is arranged in the load circuit and whose secondary windings N2, N3 are each arranged in a base circuit of one of the two inverter transistors, Q1, Q2. The driving apparatus has, for the two transistors Q1, Q2, in each case a base series resistor R1 and R4, respectively, an inductance L3 and L4, respectively, and a resistor R2 and R5, respectively, which is connected in parallel with the base-emitter junction and improves the switching behaviour of the inverter transistors Q1, Q2.

After the circuit arrangement has been switched on, the mains voltage rectified by the mains voltage rectifier GL is present across the back-up capacitor C2. The starting capacitor C9 is charged to the breakdown voltage of the diac DC via the diode D1 and the resistor R7, with the result that the diac DC generates trigger pulses for driving the base electrode of the transistor Q2 and thereby triggers the initiation of the oscillation of the half-bridge inverter Q1, Q2. With the aid of the toroidal-core transformer RK, the base electrodes of the transistors Q1, Q2 are driven in such a way that the transistors Q1, Q2 switch alternately. After the turn-on of the transistor Q2, the starting capacitor C9 is discharged via the diode D4, via the switching path of the transistor Q2 and via the emitter resistor R6 to such an extent that the diac DC no longer generates further trigger pulses. A high-frequency alternating current, whose frequency is determined by the switching cycle of the transistors Q1, Q2, flows through the load circuit and through the series-connected lamps LP1, LP2. A DC voltage whose value corresponds approximately to 1.4 times to 1.5 times the peak value of the mains voltage is built up across the smoothing capacitor C3. The coupling capacitor C4 is charged approximately to half of the voltage present across the smoothing capacitor C3. Due to alternate switching of the transistors Q1, Q2, the centre tap is alternately connected to the negative and to the positive terminal of the smoothing capacitor C3 and the potential of the centre tap is correspondingly decreased or increased. As a result, a high-frequency alternating current determined by the transistor switching cycle flows in the load circuit. During the switching intermissions of the transistors Q1, Q2, during which both transistors Q1, Q2 are in the off state, the energy stored in the lamp inductor L5 maintains the current flow through the corresponding freewheeling diode D2 and D3, respectively. The lamp inductor L5 forms a series resonant circuit with the resonance capacitor C6. The electrical components of the circuit arrangement are dimensioned in such a way that, in order to ignite a gas discharge in the low-pressure discharge lamps LP1, LP2, a resonant-increased voltage is provided across the resonance capacitor C6 and across the auxiliary ignition capacitor C8. After the gas discharge has been ignited, the series resonant circuit C6, L5 is damped by the impedance of the discharge paths of the low-pressure discharge lamps LP1, LP2.

The diode D1, the back-up capacitor C2, the trapezoidal capacitor C7 and the resonance capacitor C6 form a harmonic filter which feeds small quantities of charge into the smoothing capacitor C3 with the switching cycle of the inverter Q1, Q2 and proportionally to the mains voltage. The back-up capacitor C2, the resonance capacitor C6, the trapezoidal capacitor C7 and the diode D1 together act as a charge pump.

If the transistor Q2 turns on, then the centre tap M of the inverter Q1, Q2 is connected to the negative pole of the mains voltage rectifier output through the conductive collector-emitter path of the transistor Q2. The trapezoidal capacitor C7 is then charged in accordance with the potential difference determined by the difference between the instantaneous value of the voltage across the back-up capacitor C2 and the potential at the centre tap M. A pulsating DC voltage whose frequency is twice as large as the mains voltage frequency is present across the back-up capacitor C2. If the mains voltage passes straight through its peak point, then the trapezoidal capacitor C7 is charged approximately to 1.4 times the mains voltage value.

In the subsequent off phase of the transistor Q2, the potential at the centre tap M of the inverter Q1, Q2 and, correspondingly, the potential at the trapezoidal capacitor C7 are increased abruptly. The trapezoidal capacitor C7 thereby receives a higher potential than the smoothing capacitor C3 and can therefore be discharged via the diode D1 into the smoothing capacitor C3.

When the transistor Q1 is subsequently turned on, the potential of the centre tap M is increased to the potential of the smoothing capacitor C3. The lamp inductor L5 is charged in the opposite direction.

In the subsequent off phase of the transistor Q1, the energy stored in the lamp inductor L5 flows away into the trapezoidal capacitor C7 and into the resonance capacitor C6. Afterwards, the transistor Q2 turns on again.

In this way, energy is pumped once into the smoothing capacitor C3 per switching cycle of the inverter Q1, Q2 per period of the high-frequency AC voltage. The frequency of the alternating current flowing in the load circuit is typically more than 20 kHz. The charge portions pumped into the smoothing capacitor C3 are proportional to the instantaneous value of the voltage present across the back-up capacitor C2.

If the peak value of the lamp voltage of the series circuit of the two low-pressure discharge lamps LP1, LP2 exceeds half of the voltage of the smoothing capacitor C3, then the potential at the centre tap M is reduced, in the event of polarity reversal, to a potential lying below the earth potential of the terminal j4, and the resonance capacitor C6 is recharged in the region of the mains voltage zero crossing. The dimensioning (Table I) of the capacitances of the back-up capacitor C2 and of the resonance capacitor C6 that has been chosen in this exemplary embodiment ensures that the resonant capacitor C6 is recharged primarily via the back-up capacitor C2 and not principally from the electricity mains. The harmonic content of the mains current can therefore be kept low. In order that the resonance capacitor C6 is recharged primarily via the back-up capacitor C2 during the mains voltage zero crossing, the nominal value of the capacitance of the back-up capacitor C2 should be at least 0.33 times the nominal value of the capacitance of the resonance capacitor C6. In order to avoid excessively high charging currents, the nominal value of the capacitance of the back-up capacitor C2 should not exceed the nominal value of the capacitance of the resonance capacitor C6.

Suitable dimensioning of the electrical components of the preferred exemplary embodiment is indicated in Table I.

The invention is not restricted to the exemplary embodiment explained in more detail above. By way of example the circuit arrangement according to the invention may have additional components, such as, for example, an apparatus for preheating the electrode filaments of the low-pressure discharge lamps LP1, LP2 or a safety shutdown which switches the inverter off when the lamps are defective. In addition, the harmonic filter may have at least one further, forward-biased diode, a first electrode of this diode being connected to the DC voltage output of the mains voltage rectifier and the second electrode being connected via a junction point to the capacitor connected in parallel with the DC voltage output of the mains voltage rectifier, to the resonance capacitor, to the at least one capacitor of the harmonic filter and to the at least one diode of the harmonic filter.

TABLE I

Dimensioning of the electrical components used in the exemplary embodiment

| | |
|---|---|
| R1, R4 | 8.2 Ω |
| R2, R5 | 47 Ω |
| R3, R6 | 0.56 Ω |
| R7 | 1 MΩ |
| L1 | 2*3.9 mH |
| L2 | 2*39 mH |
| L3, L4 | 10 μH |
| L5 | 1.7 mH |
| C1 | 150 nF |
| C2 | 4.7 nF |
| C3 | 10 μF |
| C4 | 220 nF |
| C6 | 10 nF |
| C7 | 6.8 nF |
| C8 | 560 pF |
| C9 | 100 nF |
| Q1, Q2 | BUF644 |

TABLE I-continued

Dimensioning of the electrical components used in the exemplary embodiment

| | |
|---|---|
| D1, D2, D3, D4 | BYD33J |
| N1, N2, N3 | 5:2:2 Windings |
| LP1, LP2 | Fluorescent lamp each having a power consumption of 18 W, e.g. Osram Dulux D/E 18W |

What is claimed is:

1. Circuit arrangement for operating at least one low-pressure discharge lamp, comprising:

a mains voltage rectifier (GL), a capacitor (C2), connected in parallel with the DC voltage output (+,–) of the mains voltage rectifier (GL), an inverter (Q1, Q2) having a DC voltage input and a voltage output (M), a load circuit designed as a series resonant circuit, which is connected to the voltage output (M) of the inverter (Q1, Q2), the load circuit having at least one resonance capacitor (C6), a lamp inductor (L5) and terminals (j5, j6, j7, j8) for at least one low-pressure discharge lamp (LP1, LP2), a smoothing capacitor (C3) connected in parallel with the DC voltage input of the inverter (Q1, Q2), a harmonic filter having a sole diode (D1) and at least one capacitor (C7), a first terminal of the capacitor (C7) of the harmonic filter is connected to the resonance capacitor (C6), to a first electrode of the diode (D1) of the harmonic filter and to the DC voltage output (+,–) of the mains voltage rectifier (GL), the second terminal of the capacitor (C7) of the harmonic filter is connected to the voltage output (M) of the inverter (Q1, Q2), the second electrode of the diode (D1) of the harmonic filter is connected to the smoothing capacitor (C3).

2. The circuit arrangement according to claim 1, characterized in that the nominal value of the capacitance of the capacitor (C2) connected in parallel with the DC voltage output(+,–) of the mains voltage rectifier (GL) is greater than or equal to 0.33 times the nominal value of the capacitance of the resonance capacitor (C6).

3. The circuit arrangement according to claim 1, characterized in that the nominal value of the capacitance of the capacitor (C2) connected in parallel with the DC voltage output (+,–) of the mains voltage rectifier (GL) is less than or equal to the nominal value of the capacitance of the resonance capacitor (C6).

4. Circuit arrangement according to claim 1, characterized in that the harmonic filter comprises the capacitor (C2) connected in parallel with the DC voltage output (+,–) of the mains voltage rectifier (GL), the resonance capacitor (C6), the capacitor (C7) and the diode (D1).

5. Circuit arrangement for operating at least one low-pressure discharge lamp, comprising:

a mains voltage rectifier (GL), a capacitor (C2), connected in parallel with the DC voltage output (+,–) of the mains voltage rectifier (GL), an inverter (Q1, Q2) having a DC voltage input and a voltage output (M), a load circuit designed as a series resonant circuit, which is connected to the voltage output (M) of the inverter (Q1, Q2), the load circuit having at least one resonance capacitor (C6), a lamp inductor (L5) and terminals (j5, j6, j7, j8) for at least one low-pressure discharge lamp (LP1, LP2), a smoothing capacitor (C3) connected in parallel with the DC voltage input of the inverter (Q1, Q2), a harmonic filter having a first diode (D1), a second diode and a capacitor (C7), a first electrode of the second diode being connected to the DC voltage output of the mains voltage rectifier and the second electrode being connected via a junction point to the capacitor connected in parallel with the DC voltage output of the mains voltage rectifier, to the resonance capacitor, to the capacitor (C7) of the harmonic filter and to the first diode (D1) of the harmonic filter, a first terminal of the capacitor (C7) of the harmonic filter is connected to the resonance capacitor (C6), to a first electrode of the first diode (D1) of the harmonic filter and to the DC voltage output (+,−) of the mains voltage rectifier (GL), the second terminal of the capacitor (C7) of the harmonic filter is connected to the voltage output (M) of the inverter (Q1, Q2), the second electrode of the first diode (D1) of the harmonic filter is connected to the smoothing capacitor (C3).

* * * * *